US006357530B1

(12) United States Patent
Kennedy et al.

(10) Patent No.: US 6,357,530 B1
(45) Date of Patent: Mar. 19, 2002

(54) SYSTEM AND METHOD OF UTILIZING AN ELECTRIC SUBMERGIBLE PUMPING SYSTEM IN THE PRODUCTION OF HIGH GAS TO LIQUID RATIO FLUIDS

(75) Inventors: Steven C. Kennedy, Bartlesville; Roy R. Fleshman, Morrison, both of OK (US); Nathan Thompson, Tomball, TX (US)

(73) Assignee: Camco International, Inc., Houston, TX (US)

( * ) Notice: Subject to any disclaimer, the term of this patent is extended or adjusted under 35 U.S.C. 154(b) by 0 days.

(21) Appl. No.: 09/406,059

(22) Filed: Sep. 27, 1999

Related U.S. Application Data

(60) Provisional application No. 60/102,016, filed on Sep. 28, 1998.

(51) Int. Cl.[7] ..... E21B 43/00; F04F 1/18

(52) U.S. Cl. ..... 166/369; 166/105.6; 417/108

(58) Field of Search ..... 166/101, 105, 166/105.6, 369, 370, 372; 417/108

(56) References Cited

U.S. PATENT DOCUMENTS

| | | | | | |
|---|---|---|---|---|---|
| 3,605,887 A | * | 9/1971 | Lambie | ..... | 166/105 |
| 4,330,306 A | * | 5/1982 | Salant | ..... | 96/219 |
| 6,026,904 A | * | 2/2000 | Burd et al. | ..... | 166/313 |

FOREIGN PATENT DOCUMENTS

| | | | | | |
|---|---|---|---|---|---|
| GB | 2 239 676 | | 7/1991 | ..... | F04D/31/00 |
| GB | 2 264 147 | | 8/1993 | ..... | F04D/31/00 |
| WO | WO 92/0837 | * | 5/1992 | | |
| WO | WO 93/07391 | | 4/1993 | ..... | F04D/13/04 |

OTHER PUBLICATIONS

Berger et al., Modern Petroleum (A Basic Primer of the Industry), 1978, PennWell Publishing Company, pp. 149–155.*

P.M. Carvalho, A.L. Podio, K. Sepehmoori, entitled "Modeling A Jet Pump With An Electrical Submersible Pump For Production Of Gassy Petroleum Wells", SPE 48934, pp. 1–13, 1986, Society of Petroleum Engineers, Inc.

* cited by examiner

*Primary Examiner*—David Bagnell
*Assistant Examiner*—Jennifer R. Dougherty
(74) *Attorney, Agent, or Firm*—Fletcher, Yoder & Van Someren

(57) ABSTRACT

A system for producing production fluids from a wellbore while removing gas that collects in pockets within the wellbore. The system includes an electric submergible pumping unit. The unit includes a submergible pump powered by a submergible motor. The fluid discharged by the pump is forced through a pressure reduction device, such as a jet pump, to create a low pressure area. This low pressure area is coupled via a conduit to a gas pocket creation area within the wellbore. For example, gas pockets may develop beneath a packer disposed above the electric submergible pumping system. The low pressure area at the pressure reduction device draws the gas into the discharged production fluid and delivers the mixture to a collection at the earth's surface.

5 Claims, 4 Drawing Sheets

SYSTEM AND METHOD OF UTILIZING AN ELECTRIC SUBMERGIBLE PUMPING SYSTEM IN THE PRODUCTION OF HIGH GAS TO LIQUID RATIO FLUIDS

CROSS REFERENCE TO RELATED APPLICATION

The present invention claims the benefit of provisional patent application No. 60/102,016, filed Sep. 28, 1998, titled, "High Gas Liquid Ratio Electric Submergible Pumping System Utilizing A Jet Pump."

FIELD OF THE INVENTION

The present invention relates generally to pumping production fluids from a well, and particularly to a system and method that facilitates the pumping of production fluids having a high gas to liquid ratio.

BACKGROUND OF THE INVENTION

In producing petroleum and other useful fluids from production wells, it is generally known to provide a pumping system for raising the fluids collected in a well. Production fluids enter a wellbore via perforations formed in a well casing adjacent a production formation. Fluids contained in the formation collect in the wellbore and may be raised by the pumping system to a collection point.

In an exemplary pumping system, such as a submergible pumping system, the system includes several components. For example, a submergible electric motor is used to power a submergible pump, typically a centrifugal pump.

The pumping system is deployed within the wellbore by a deployment system, such as production tubing, through which the production fluids are pumped to the earth's surface. It is also common practice to set a packer within the wellbore casing. The packer is disposed between the wellbore casing and the deployment system or pumping system components.

In certain wells, such as in many offshore oil wells, deep set packers are used to protect the wellbore casing. During production, such wells can produce free gas that accumulates beneath the packer. The gas pocket can continue to grow during pumping. If the gas pocket becomes sufficiently large, it can reach the pump intake and cause slugging to occur in the electric submergible pumping system. To avoid this problem, well operators can maintain a bottom hole pressure above the bubble point of the produced fluid. However, the higher bottom hole pressure reduces the rate of production at these wells.

Attempts have been made to remove the gas, while maintaining higher production rates. For example, coil tubing can be used to vent the gas from beneath the packer to the surface. However, such methods substantially complicate the completion, e.g. electric submergible pumping system.

SUMMARY OF THE INVENTION

A system is provided for producing production fluids from a wellbore. The system is comprised of an electric submergible pumping system that includes at least one submergible pump, at least one pressure reduction device, at least one intake disposed to draw liquid, and at least one secondary intake coupled to the at least one pressure reduction device. The at least one pressure reduction device is powered by the at least one submergible pump and draws a gas from the wellbore through the at least one secondary intake.

According to another aspect of the invention, a system is provided for removing free gas from a wellbore. The system is comprised of: a submergible pump; a pressure reduction device through which the submergible pump forces a flow of wellbore fluid; a gas inlet coupled to the pressure reduction device and disposed within the wellbore at a gas pocket formation region; and source of power for the pump.

According to another aspect of the invention, a method is provided of producing fluids and removing free gas from a wellbore. The method is comprised of locating a submergible pump in a wellbore and powering the submergible pump with a submergible motor. The method further includes discharging wellbore fluid flow from the submergible pump through a pressure reduction device to create a low pressure area. The method further includes coupling the low pressure area with a gas formation area disposed in the wellbore.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENTS

Generally, the present invention relates to methods and systems that utilize a jet pump in novel fashion to facilitate pumping of liquids with a high gas to liquid ratio. Centrifugal pumps commonly are used in downhole environments to pump production fluids. However, it is undesirable and potentially damaging to permit bubbles or pockets of gas in high gas to liquid ratio fluids to be pumped through the centrifugal pump. Accordingly, the bubbled gas or at least a portion of the gas should be removed from the production fluid prior to entering the centrifugal pump. However, the released gas can collect in the wellbore and cause further problems, as discussed above. Also, even without removing gas from the production fluid, a gas pocket can form beneath the packer and present problems for the pumping system. According to the present invention, pump, e.g. a jet pump can be driven by the produced fluid stream and utilized to remove the gas from the wellbore and introduce it into the produced fluid stream above the initial centrifugal pump.

Figure 1:
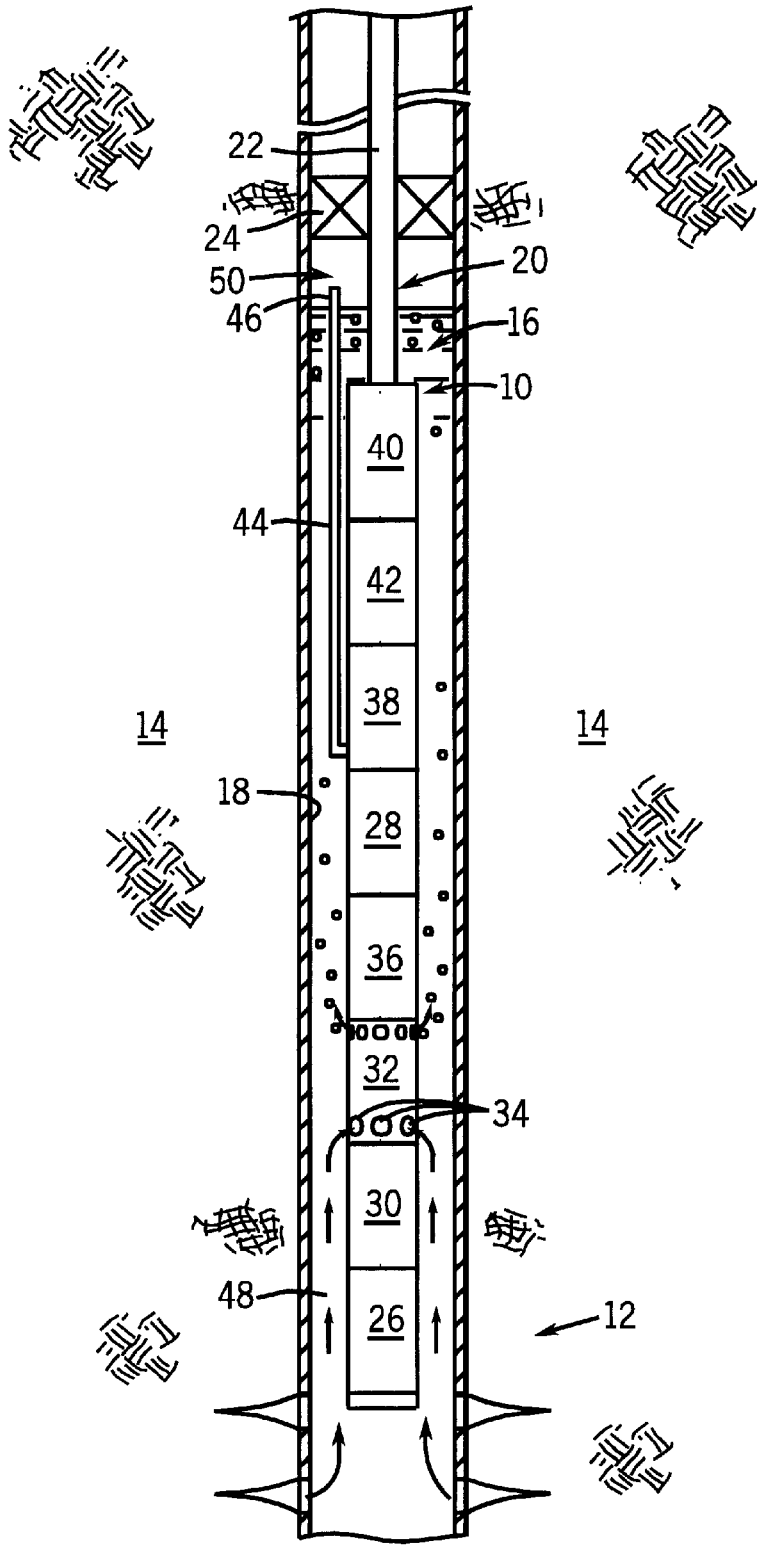
FIG. 1 is a front elevational view of an electric submergible pumping system positioned in a wellbore, according to a preferred embodiment of the present invention.

Referring generally to FIG. 1, a first preferred embodiment of the present invention is illustrated. In this embodiment, a pumping system 10 is designed for deployment in a well 12 within a geological formation 14 containing desirable production fluids, such as petroleum. In a typical application, a wellbore 16 is drilled and lined with a wellbore casing 18. Pumping system 10 is deployed within wellbore 16 by a deployment system 20, such as production tubing 22.

A packer 24 is disposed between production tubing 22 and wellbore casing 18. In this environment, packer 24 is disposed above pumping system 10 to protect wellbore casing 18.

Pumping system 10 preferably includes a submergible motor 26 for driving a submergible pump 28, such as a centrifugal pump. Connected between motor 26 and pump 28 is a motor protector 30 and an intake 32 disposed between motor production 30 and pump 28. Often, intake 32 comprises a gas separator. In either case, intake or gas separator 32 includes intake openings 34 through which fluid enters pumping system 10 from wellbore 16. Optionally, an advanced gas handling system 36 may be disposed between intake 32 and pump 28 to further reduce any bubbles of gas contained in the production fluid. A preferred system 36 is the Advanced Gas Handling System available from Reda of Bartlesville, Okla., a Camco International Company.

A pump 38, such as a jet pump, is disposed above pump 28. Additionally, a second submergible pump 40, such as a centrifugal pump, is disposed above jet pump 38 in the string of components of pumping system 10. Optionally, a second advanced gas handling system 42 may be disposed between jet pump 38 and second submergible pump 40. A conduit 44 is connected to jet pump 38 and extends upwardly towards packer 24. Conduit 44 includes an inlet 46 disposed towards packer 24 for communication with any gas pockets that form beneath packer 24.

During operation of pumping system 10, a fluid 48 disposed in wellbore 16 naturally may be at a pressure that is below the bubble point pressure of the fluid. Thus, gas bubbles can be formed. This gas preferably is removed by gas separator 32. Gas expelled from, for example, gas separator 32 is forced into the annulus between pumping system 10 and wellbore casing 18. The naturally occurring gas and any expelled gas rises upwardly until it is trapped beneath packer 24 forming a gas pocket SO.

Gas pocket 50 is reduced and controlled by pulling gas back into the production stream via jet pump 38 and conduit 44. When the gas is reintroduced into the production stream at jet pump 38, the production fluid preferably is maintained at a pressure above the bubble point. Thus, bubbles and/or gas pockets do not form in the production stream, and submergible pump 40 is readily able to pump the produced fluid up production tubing 22 to the earth's surface. Maintenance of the an internal pressure above the bubble point pressure of the produced fluid at the jet pump 38 does not substantially effect the rate at which the fluid may be produced.

In the illustrated system, submergible pump 28 effectively acts as a charge pump for powering jet pump 38. Pump 28 is sized and designed to pump at the desired liquid rate through the jet pump to maintain performance of the jet pump 38. The second submergible pump 40 effectively acts as the production pump able to pump the production fluid and entrained gas to the surface. The mixture is maintained at sufficiently high pressure to avoid formation of bubbles in pump 40.

Figure 2:
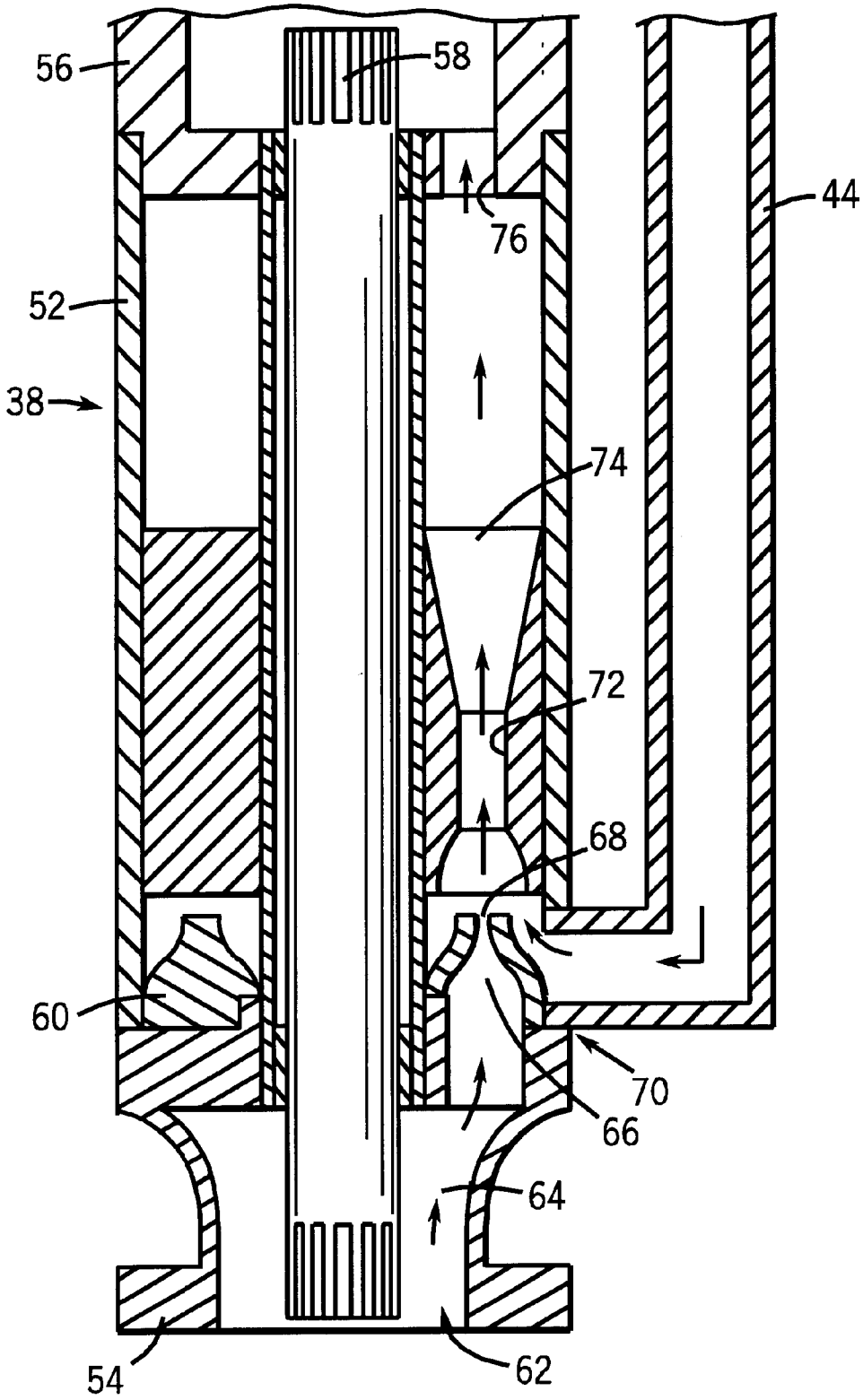
FIG. 2 is a cross-sectional view of a jet pump used with the system of FIG. 1, according to a preferred embodiment of the present invention.

A preferred embodiment of jet pump 38 is illustrated in FIG. 2. Jet pump 38 includes an external housing 52 having a lower mounting end 54 and an upper mounting end 56. A shaft 58 is rotatably mounted within and extends through housing 52 and mounting ends 54 and 56. Shaft 58 is part of several shaft portions connected from motor 26 through the various components to power, for instance, centrifugal pumps 28 and 40.

At least one and preferably a plurality of jet pump nozzle 60 are disposed about shaft 58 within housing 52. Jet pump 38 has a fluid inlet 62 disposed through mounting end 54. Fluid flows through inlet 62 along a fluid corridor 64 to an interior cavity 66 of each jet pump nozzle 60. Each jet pump nozzle 60 also includes a narrow outlet or orifice 68 in fluid communication with internal cavity 66.

The cross-sectional area of each orifice 68 is smaller than the largest cross-sectional area of each jet pump nozzle 60. As fluid flows through inlet 62 and fluid corridor 64, it creates a static head ($P_1$) in internal cavity 66. As this fluid is forced through orifice 68 of each nozzle 60, the velocity of flow is increased, thereby creating a low-pressure area ($P_2$) at the discharge of each jet pump nozzle 60.

Conduit 44 is connected to jet pump 38 at an inlet 70. Inlet 70 is disposed externally of jet pump nozzle or nozzles 60 proximate the area of discharge of fluid through orifice 68. Thus, the liquid flowing through orifice 68 must be of a velocity that will sufficiently lower the pressure at $P_2$ to permit the gas in gas pocket 50 to be forced through conduit 44 and opening 70 into combination with the fluid discharged through orifice 68.

The gas and fluid are mixed in a throat region 72 of jet pump 38. The mixture of fluid and gas flows through throat region 72 and into the expanded diffuser region 74. Preferably, the pressure ($P_3$) in diffuser region 74 is higher than the downhole pressure external to pumping system 10. Most preferably, the pressure $P_3$ is maintained higher than the bubble point pressure of the mixture of fluid from orifice 68 and gas from inlet 70. This higher pressure prevents formation of bubbles as the mixture is moved through second submergible pump 40. In some design applications, it may be desirable to maintain pressure $P_3$ below the bubble point pressure of the mixture. In this situation, however, it may be necessary to utilize an advanced gas handling system 42 to limit the gas bubbles and pockets flowing into pump 40. Thus, as the gas and liquid mixture exits diffuser 74 through an outlet 76, it enters second submergible pump 40 either directly or through advanced gas handling system 42.

Figure 3:
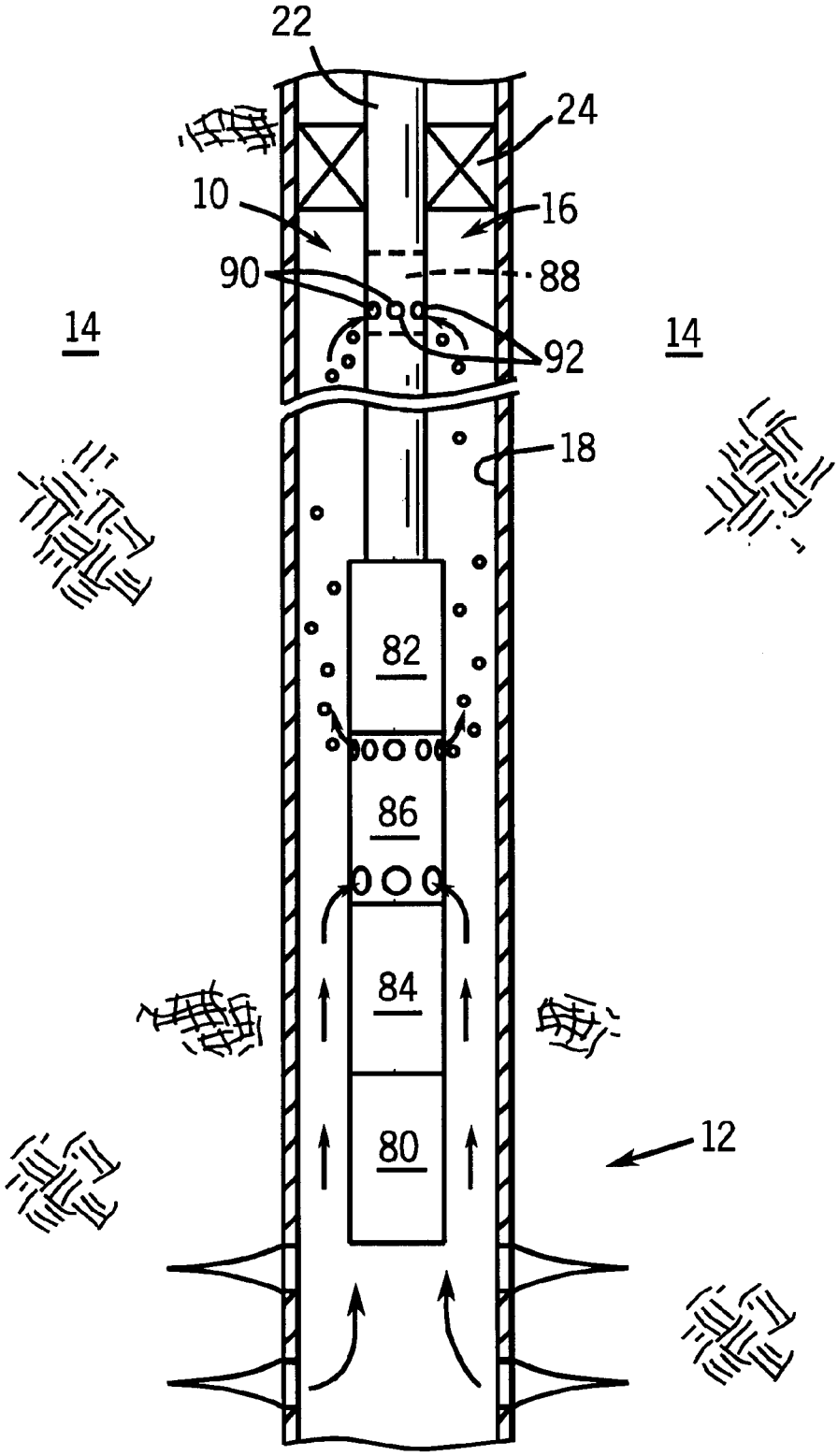
FIG. 3 is a front elevational view of an alternate embodiment of the system illustrated in FIG. 1.

Referring generally to FIG. 3, an alternate embodiment of pumping system 10 is illustrated. In this embodiment, Pumping system 10 includes a submergible motor 80 connected to a submergible pump 82, such as a centrifugal pump. Disposed between motor 80 and pump 82 may be a motor protector 84 and a fluid intake 86. The fluid intake may comprise a gas separator. Additionally, pumping system 10 includes a jet pump 88 disposed between pump 82 and packer 24. An exemplary jet pump 88 is a wireline retrievable jet pump designed for placement at a specific location within production tubing 22. Jet pump 88 has a gas inlet 90 through which gas is pulled from wellbore 16 beneath packer 24. If jet pump 88 is a wireline retrievable jet pump disposed within production tubing 22, inlet 90 must be aligned with corresponding openings 92 through production tubing 22.

In operation, motor 12 drives pump 82 which, in turn, intakes production fluid from wellbore 16 and discharges it upwardly into production tubing 22. The discharge of pump 82 is flowed through jet pump 88 to create suction at inlet 90. This suction removes gas accumulated beneath packer 24 and causes it to be entrained in the produced fluid stream pumped to the earth's surface through production tubing 22.

Figure 4:
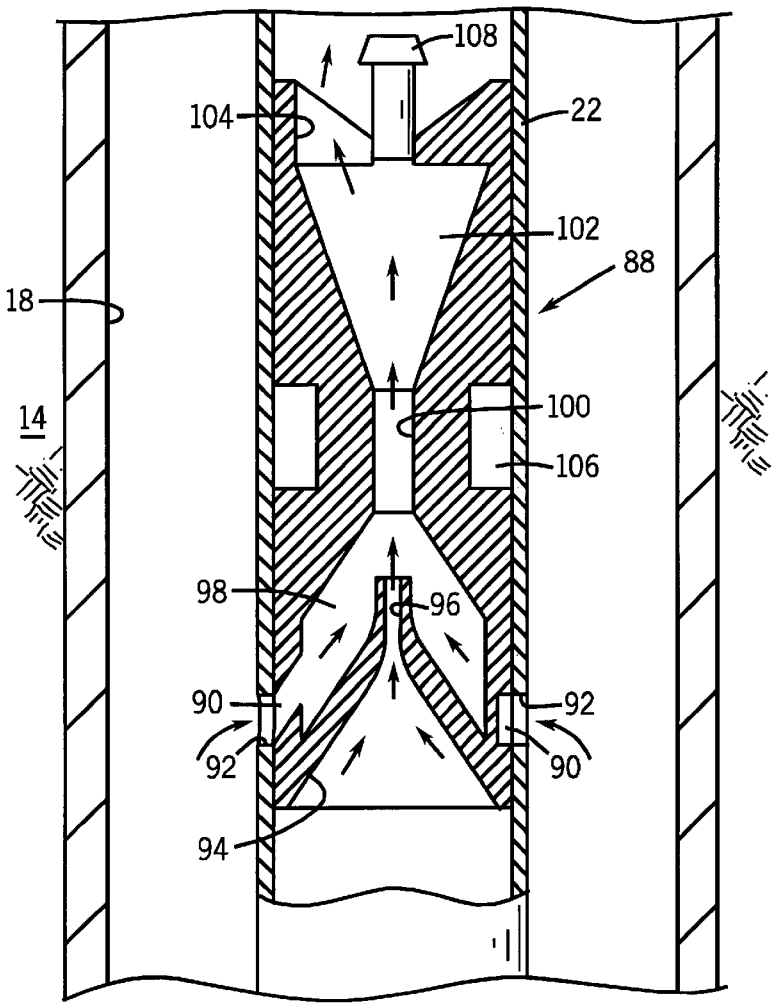
FIG. 4 is a cross-sectional view of the jet pump illustrated in FIG. 3.

A preferred embodiment of jet pump 88 is illustrated in FIG. 4. As shown, the fluid discharged from pump 82 flows into a jet pump nozzle 94. Then, the fluid is discharged from nozzle 94 through a narrower orifice 96. As the fluid is forced through narrower orifice 96, its velocity is increased, thereby causing a low pressure area 98 at the point of discharge. Low pressure area 98 allows gas from wellbore 16, collected beneath packer 24, to be forced through openings 92 and inlet 90 into low pressure area 98. The fluid flowing through orifice 96 and the gas flowing into low pressure area 98 are mixed at a throat area 100 which maintains a relatively high velocity of the fluid/gas mixture. After the mixture flows through throat 100 it moves into an expanded diffuser region 102 and exits jet pump 88 through an outlet 104 for continued flow through production tubing 22.

In the illustrated embodiment, jet pump 88 preferably includes a latch mechanism 106. Latch mechanism 106 maintains jet pump 88 at a specific, desired location within production tubing 22. Additionally, jet pump 88 preferably includes a wireline connector 108 to facilitate retrieval of jet pump 88.

Figure 5:
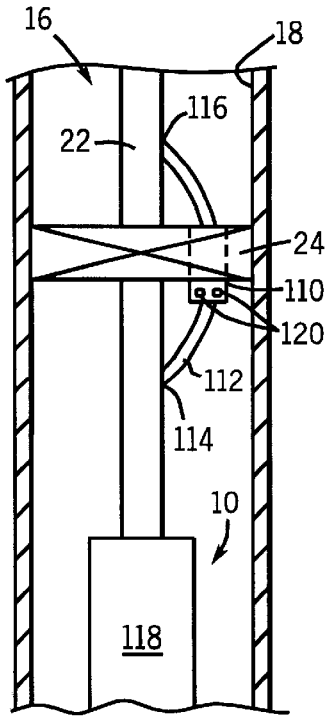
FIG. 5 is a front elevational view of a jet pump system, according to an alternate embodiment of the present invention.

Another embodiment of the present invention is illustrated in FIG. 5. In this embodiment, a jet pump 110 is disposed in a bypass conduit 112. Bypass conduit 112 is connected to production tubing 22 at an inlet 114 and an outlet 116.

In operation, a submergible pump 118 of pumping system 10, pumps a production stream upwardly through production tubing 22. A portion of this production stream is diverted through bypass conduit 112 via inlet 114. This portion of the fluid flow is routed through jet pump 110 which removes gas accumulated beneath packer 24. Jet pump 110 pulls gas from wellbore 16 via inlets 120 and combines the gas with the fluid flowing through jet pump 110, as described generally above. The mixture is then reinjected into the main production stream above packer 24 at outlet 116. A flow restrictor 122, such as an orifice, is used to lower the pressure in the main production stream to the pressure of the mixture in order to facilitate the reintroduction of the mixture into the main production stream.

In this embodiment, packer 24 preferably is a side pocket packer. Jet pump 110 is mounted directly in the side pocket of packer 24 for ready access to any gas pocket formed beneath packer 24.

It will be understood that the foregoing description is of preferred embodiments of this invention, and that the invention is not limited to the specific form shown. For example, a variety of components can be used or interchanged in a given pumping system; a variety of jet pump designs may be utilized; the pressures within the wellbore, jet pump and production tubing can be controlled according to the specific environment or application; and a variety of packers and deployments systems may be utilized. These and other modifications may be made in the design and arrangement of the elements without departing from the scope of the invention.

What is claimed is:

1. A system for removing free gas from a wellbore, comprising;

an electric submergible pumping system coupled to a deployment tubing through which a fluid may be produced, the electric submergible pumping system comprising a submergible pump and a submergible motor to power the pump;

a bypass tube having an inlet coupled to the deployment tubing and an outlet coupled to the deployment tubing;

a pressure reduction device disposed in the bypass tube and through which the submergible pump forces a flow of wellbore fluid; and a gas inlet coupled to the pressure reduction device and disposed within the wellbore at a gas pocket formation region.

2. The system as recited in claim 1, wherein the pressure reduction device is disposed downstream of the submergible pump.

3. The system as recited in claim 1, wherein the pressure reduction device comprises a jet pump.

4. The system as recited in claim 1, wherein the pressure reduction device comprises a plurality of jet pump nozzles.

5. The system as recited in claim 1, further comprising a conduit in communication with the gas inlet and the pressure reduction device.

* * * * *